US008556565B2

(12) United States Patent
Reyes

(10) Patent No.: US 8,556,565 B2
(45) Date of Patent: Oct. 15, 2013

(54) TENNIS BALL RETRIEVAL DEVICE

(75) Inventor: Richard Roman Reyes, Lexington, KY (US)

(73) Assignee: Richard R. Reyes, Lexington, KY (US)

( * ) Notice: Subject to any disclaimer, the term of this patent is extended or adjusted under 35 U.S.C. 154(b) by 229 days.

(21) Appl. No.: 13/228,068

(22) Filed: Sep. 8, 2011

(65) Prior Publication Data

US 2012/0093621 A1 Apr. 19, 2012

Related U.S. Application Data

(60) Provisional application No. 61/394,643, filed on Oct. 19, 2010.

(51) Int. Cl.
*B60P 1/00* (2006.01)

(52) U.S. Cl.
USPC ..... 414/439; 294/19.2; 414/441

(58) Field of Classification Search
USPC ..... 414/437, 439, 440, 441; 294/19.2
See application file for complete search history.

(56) References Cited

U.S. PATENT DOCUMENTS

| | | | | | |
|---|---|---|---|---|---|
| 1,650,796 | A | * | 11/1927 | Kellogg | 56/328.1 |
| 2,321,387 | A | * | 6/1943 | Jackson | 53/391 |
| 2,658,637 | A | * | 11/1953 | Bailey | 414/440 |
| 3,593,868 | A | | 7/1971 | Folz | |
| 3,595,000 | A | * | 7/1971 | Recker | 56/328.1 |
| 3,888,370 | A | * | 6/1975 | Gamblin | 414/440 |
| 3,986,324 | A | * | 10/1976 | Harriott et al. | 56/327.1 |
| 4,004,806 | A | | 1/1977 | Malik | |
| 4,046,131 | A | | 9/1977 | Clark | |
| 4,077,533 | A | | 3/1978 | Meyer | |
| 4,112,911 | A | | 9/1978 | Petrick | |
| 4,116,192 | A | | 9/1978 | Scott | |
| 4,221,524 | A | | 9/1980 | Morris | |
| 4,252,490 | A | | 2/1981 | Keller | |
| 4,318,654 | A | * | 3/1982 | Lee | 414/440 |
| 4,550,465 | A | * | 11/1985 | Chrisley | 15/84 |
| 4,721,428 | A | * | 1/1988 | Rohrer et al. | 414/439 |
| 4,735,544 | A | * | 4/1988 | Stotts | 414/440 |
| 4,844,527 | A | | 7/1989 | Ray | |
| 5,301,991 | A | | 4/1994 | Chen | |
| 5,368,351 | A | | 11/1994 | Cuti | |
| 5,437,488 | A | | 8/1995 | Richmond | |
| 5,527,075 | A | | 6/1996 | Jones | |
| 6,079,930 | A | | 6/2000 | Valdes-Rodriguez | |
| 7,341,294 | B2 | | 3/2008 | Olmstead | |
| 8,056,177 | B2 | * | 11/2011 | Hammad | 15/78 |
| 2003/0073519 | A1 | | 4/2003 | Shau | |
| 2006/0068948 | A1 | | 3/2006 | Mendoza | |

FOREIGN PATENT DOCUMENTS

| | | | | |
|---|---|---|---|---|
| CH | 662058 AS | * | 9/1987 | 294/19.2 |

* cited by examiner

*Primary Examiner* — James Keenan
(74) *Attorney, Agent, or Firm* — Legal Zoom; Sarah Bourland; Adam Thomas

(57) ABSTRACT

A ball retrieval device that picks up tennis balls from the ground and vertically elevates them into a cart. The ball retrieval device includes an L-shaped frame including a first section and a second section. A feeder system is located on the horizontal section of the L-shaped frame and a paddle wheel system is connected to the feeder system. A lift system is located on the vertical section of the L-shaped frame.

5 Claims, 3 Drawing Sheets

TENNIS BALL RETRIEVAL DEVICE

CROSS-REFERENCE TO RELATED APPLICATIONS

This application claims the benefit of priority to U.S. Provisional Application No. 61/394,643 filed Oct. 19, 2010, the contents of which are incorporated herein by reference.

BACKGROUND OF THE INVENTION

The present invention generally relates to a device for retrieving tennis balls from the ground. More particularly, the present invention relates to a tennis ball retrieval device that picks up tennis balls from the ground and vertically elevates them into a cart.

In recent years, tennis has become an extremely popular sport. In the sport of tennis, continually practicing is necessary to develop the required skills. Usually, many balls are used while practicing tennis. Unfortunately, the process of retrieving or collecting tennis balls requires a considerable amount of bending over and/or stooping, in order to reach the tennis balls. This is a tedious and time consuming task that is hard on the spine and the back muscles of the player.

As can be seen, there is a need for a ball retrieval device capable of picking up tennis balls lying on the ground, avoiding the necessity of the player bending over or stooping at any time to pick up the tennis balls.

SUMMARY OF THE INVENTION

In one aspect of the present invention, a ball retrieval device includes an L-shaped frame including a first section and a second section, a feeder system located on the horizontal section of the L-shaped frame, a paddle wheel system connected to the feeder system, and a lift system located on the vertical section of the L-shaped frame.

These and other features, aspects and advantages of the present invention will become better understood with reference to the following drawings, description and claims.

DETAILED DESCRIPTION OF THE INVENTION

Figure 1:
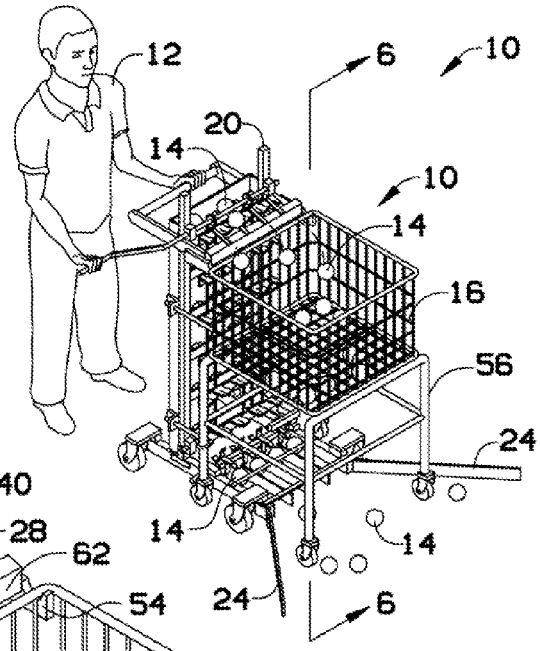
FIG. 1 illustrates a perspective front view of a ball retrieval device according to an exemplary embodiment of the present invention showing the ball retrieval device in use.
Figure 2:
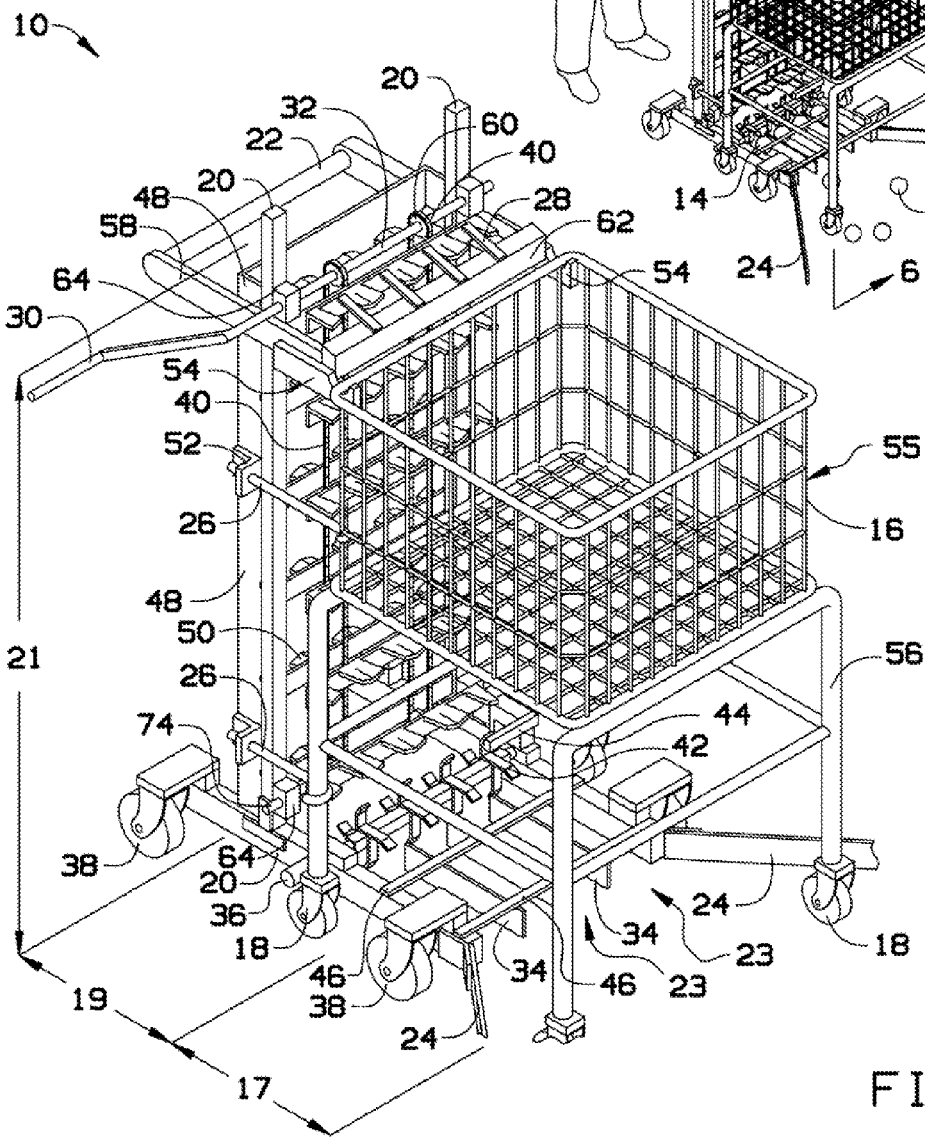
FIG. 2 illustrates a perspective front view of the ball retrieval device of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a tennis ball retrieval device that picks up tennis balls from the ground and vertically elevates them into a cart.

FIGS. 1-6 illustrate a ball retrieval device 10 according to an exemplary embodiment of the present invention. A user 12 may push the ball retrieval device 10 over balls 14 while turning a hand crank handle 30 as the balls 14 are picked up and placed into a ball cart 16.

The ball retrieval device 10 may include an L-shaped frame 20. The horizontal section of the L-shaped frame 20 may include a feeder system 17 and a paddle wheel system 19. The vertical section of the L-shaped frame 20 may include a lift system 21. The L-shaped frame 20 may be adapted to be connected on the back of and under the ball cart 16. The ball cart 16 may include a support frame 56, a plurality of casters 18 connected to the ends of the support frame 56, a push handle 22 including a handle frame 58, and a collection basket 55 mounted on top of the support frame 56.

The feeder system 17 may introduce the balls 14 into the ball retrieval device 10. The size of the feeder system 17 may depend on the size of the ball retrieval device 10. In some embodiments, the feeder system 17 may be from about 10 to about 18 inches long, typically 14 inches long, and from about 10 to about 18 inches wide, typically about 14 inches wide. The feeder system 17 may include crossbars 46 having an arm 24 on each end. The two arms 24 may extend forward and out of the L-shaped frame 20. The arms 24 may be connected to the crossbar 46 forming a V-shaped pattern to significantly increase the sweep area. The two arms 24 may be foldable arms. The length of the arms 24 may depend on the size of the ball retrieval device 10. The length of the arms 24 may be from about 25 to about 35 inches, typically 30 inches long. The arms 24 and crossbar 46 may be made of a sturdy material. In some embodiments, the arms 24 and crossbar 46 may be made of metal or plastic. A plurality of dividers 34 may be placed between the crossbars 46. Once inside the feeder system 17, as the user 12 pushes the ball retrieval device 10, the balls 14 may be fed into channels 23 formed by the dividers 34.

The paddle wheel system 19 may be operatively connected to the feeder system 17 at the end of the channels 23. The paddle wheel system 19 may help in moving the balls 14 towards the lift system 21 to start the vertical lift of the balls 14. The paddle wheel system 19 may include a bar 36 having a plurality of rotating vanes 42. The size of the rotating vanes 42 may depend on the distance between the bar 36 and the ground (not shown). As the rotating vanes 42 move, the balls 14 may be pushed toward the lift system 21. A stopper 44 may be operatively connected to the rotating vanes 42 in order to stop the pushing of the balls 14.

The lift system 21 may vertically move the balls 14 and drop them inside the ball cart 16. The lift system 21 may include a plurality of shelves 50 attached to chains 40 on sprockets 60. The sprockets 60 may be mounted on an upper crank shaft 32 and a lower crank shaft 74. Each one of the upper crank shaft 32 and the lower crank shaft 74 may be attached to the L-shaped frame 20 by using support blocks 64. A panel 48 may be placed on a back side of the lift system 21 to prevent the balls 14 from leaving the ball retrieval device 10.

The number of shelves 50 may depend on the size of the ball retrieval device 10. In some embodiments, the ball retrieval device 10 may include twelve shelves. The upper crank shaft 32 has a crank handle 30 attached to one of its ends. The crank handle 30 may be rotated by the user 12 to provide the necessary force for vertically lifting the balls 14 and dropping them into the collection basket 55.

A first fastener system 26, a second fastener system 52, and a third fastener system 54 may be used to secure the ball retrieval device 10 to the ball cart 16. The first fastener system 26 and the second fastener system 52 may be a commercial available fastener device. In some embodiments, the first fastener system 26 and the second fastener system 52 may be a J-hook device. The third fastener system 54 may be a mounting bracket connected to the upper section of the ball cart 16.

Figure 3:
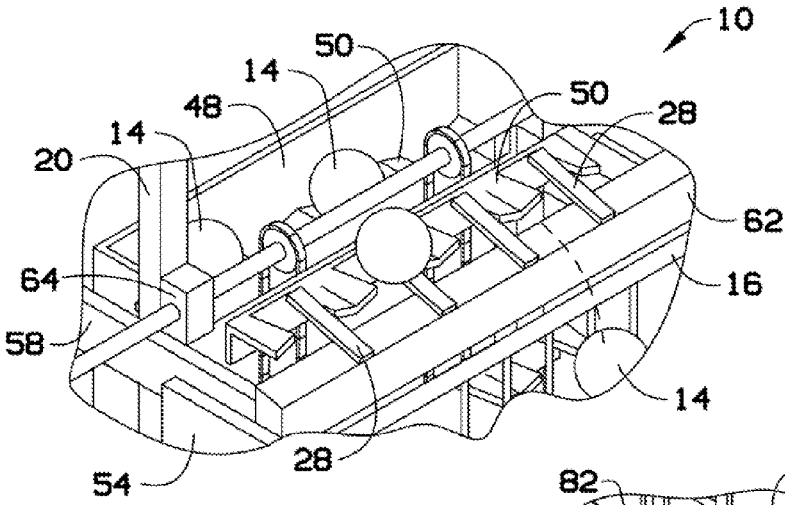
FIG. 3 illustrates a detailed view of the ball retrieval device of FIG. 1 showing a top section of a lift system according to the present invention.

As can be seen from FIG. 3, as the balls 14 reach the top of the lift system 21, a set of deflector fingers 28 connected to a resting bar 62 may guide the balls into the collection basket 55 of the ball cart 16. The deflector fingers 28 may be made of a sturdy material. In some embodiments, the deflector fingers 28 may be made of metal or plastic.

Figure 4:
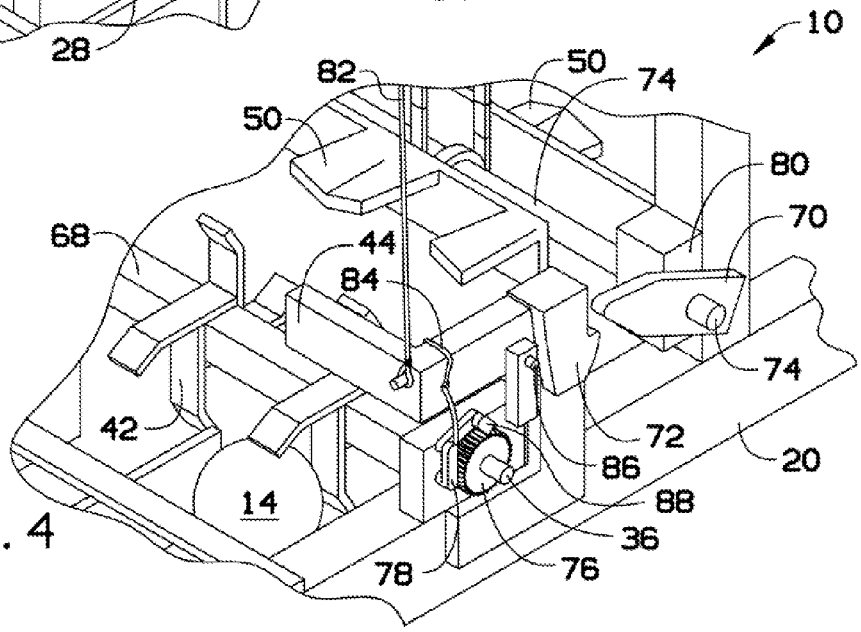
FIG. 4 illustrates a perspective front view of the ball retrieval device of FIG. 1 showing a trigger and detent device for a paddle wheel system according to the present invention.
Figure 5:
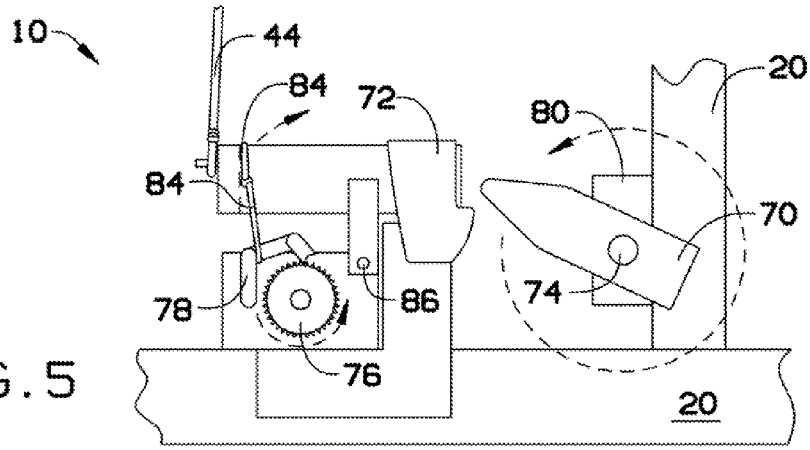
FIG. 5 illustrates a side view of a trigger and detent device for a paddle wheel system of FIG. 4.
Figure 6:
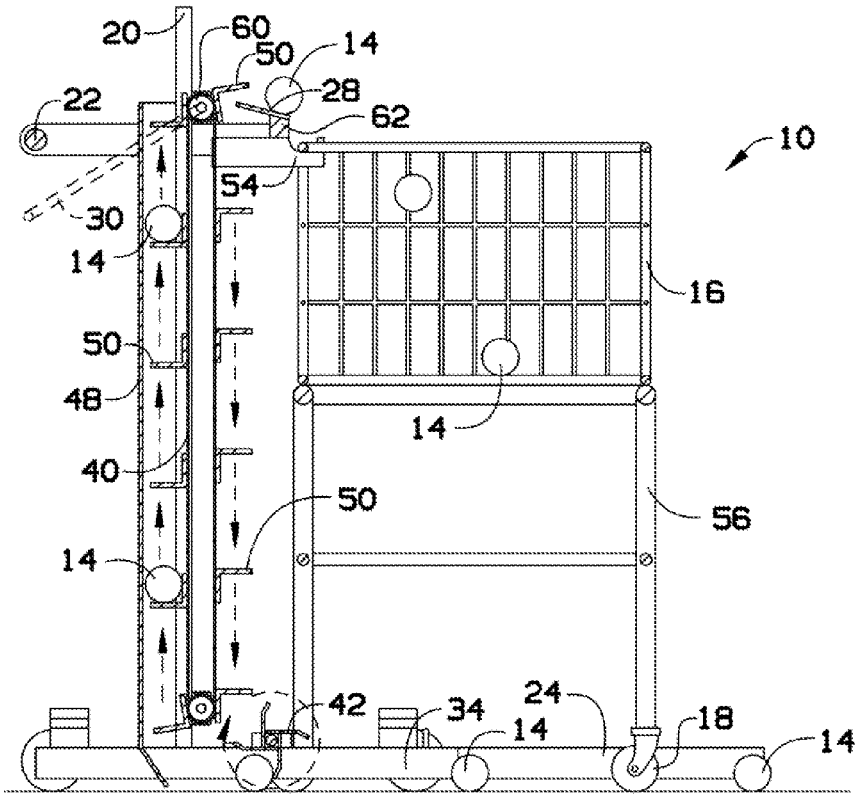
FIG. 6 illustrates a cross-sectional view of the ball retrieval device taken along line 6-6 of FIG. 1.

FIGS. 4-5 illustrate a timing device 72 operatively connected to the stopper 44. The timing device 72 may allow the balls 14 to enter the shelves 50 of the lift system 21 on a synchronized basis.

Pushing the cart 16 forward may force the balls 14 against the rotating vanes 42 mounted at right angles on a timing shaft 68. The rotating vanes 42 may be held in a locked position by the stopper 44. Synchronization may be required for the balls 14 to enter the lift system 21 in an orderly and timely manner. The user may push forward the cart 16 and by the rotation of the crank handle 30, the rotating knock off bar 70 driven by the crank handle 30 may hit the timing device 72, which may quickly raise the stopper 44 and allows the rotating vanes 42 to rotate one quarter turn. This action may allow one to four balls 14 into the lift system 21 just in time for shelves 50 to pick them up and elevate the balls 14 to the top, dumping the balls 14 into the basket 16, 92. Because there is no loose rotation or counter rotation, the rotation vanes 42 may be locked in the correct position for the next cycle quarter rotation. The stopper 44 may drop down and a ratchet wheel 76 may be stopped with a detent arm 78 at the same time. The stopper 44 and the detent arm 78 may fall into position by their weights and gravity. In some embodiments, the stopper 44 and the detent arm 78 may by controlled by mounted spring tension.

A manual release cord 82 and cord 84 may be use if a jam occurs. The user may stop pushing and cranking, pull up the cord 84 which may lift the stopper 44 and detent arm 78. This may let the rotating vanes 42 to freely rotate while pulling the cart 16 in reverse, and allowing the lift system 21 to empty out for a restart.

A plurality of wheels may be secured to the horizontal section of the L-shaped frame 20 to help in moving the ball retrieval device 10.

The lift system 21 may be manually operated. In some embodiments, the lift system 21 may be operated by electrical power.

Figure 7:
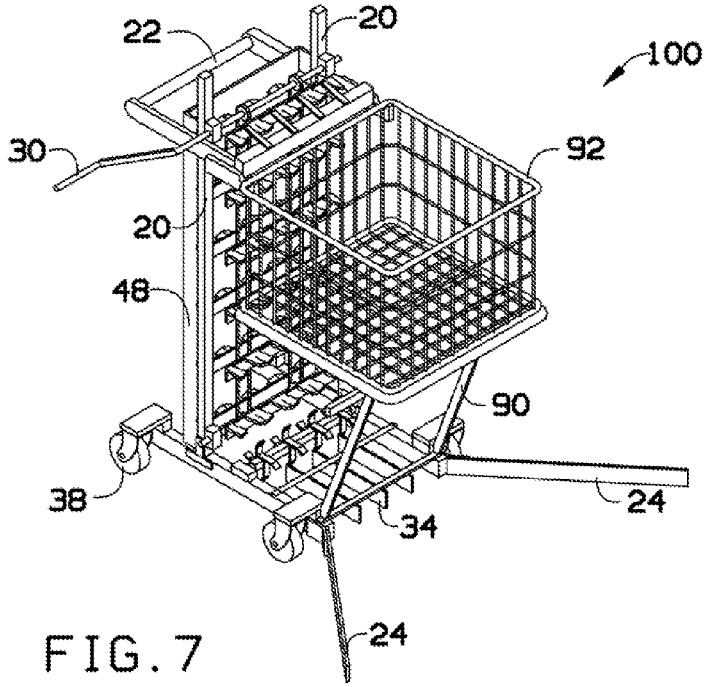
FIG. 7 illustrates a perspective front view of a ball retrieval device according to another exemplary embodiment of the present invention.

FIG. 7 illustrates a ball retrieval device 100 according to another exemplary embodiment of the present invention. The ball retrieval device 100 may be included in an integrated basket 92 secured to the L-shaped frame 20 by a support frame 90.

In some embodiments, the shelves 50 may be made of an adhesive material. In some embodiments, the chains 40 may be belts.

The user 12 may push the ball retrieval device 10 over the scattered balls 14 while rotating the crank handle 30 to pick up the balls 14 and deposit them into the ball cart 16.

The ball retrieval device 10 provides a quick and easy way of picking up the balls 14.

It should be understood, of course, that the foregoing relates to exemplary embodiments of the invention and that modifications may be made without departing from the spirit and scope of the invention as set forth in the following claims.

What is claimed is:

1. A ball retrieval device comprising:

an L-shaped frame including a first section and a second section;

a feeder system located on the first section of the L-shaped frame;

a paddle wheel system connected to the feeder system; and a lift system located on the second section of the L-shaped frame;

wherein the paddle wheel system includes a bar having a plurality of rotating vanes;

wherein the lift system includes a plurality of shelves adapted to carry balls, wherein the shelves are attached to chains mounted on sprockets, wherein the sprockets are mounted on an upper crank shaft and a lower crank shaft attached to the L-shaped frame, and wherein the upper crank shaft has a crank handle attached to one end;

wherein the rotation of the crank handle vertically lifts the shelves carrying the balls and drops the balls into a basket;

wherein the rotation of the crank handle activates a knock off bar driven by the upper crank shaft, wherein the knock off bar hits a timing device operatively connected to a stopper which normally holds the rotating vanes in a locked position, wherein the hitting of the timing device by the knock off bar raises the stopper away from its position locking the rotating vanes thereby allowing the rotating vanes to rotate, and wherein the rotation of the rotating vanes introduces the balls into the shelves in an orderly, synchronized manner to avoid jamming of the device.

2. The ball retrieval device according to claim 1, wherein the L-shaped frame is adapted to be connected to a ball cart.

3. The ball retrieval device according to claim 1, wherein the feeder system includes a first crossbar, a second crossbar, an arm on each end of the first crossbar, a plurality of dividers placed between the first and the second crossbars, and a plurality of channels formed between adjacent dividers.

4. The ball retrieval device according to claim 3, wherein the arms extend forward and out of the L-shaped frame and wherein the arms are connected to the crossbar forming a V-shaped pattern.

5. The ball retrieval device according to claim 1, wherein the lift system further includes a plurality of deflector fingers connected to a resting bar to guide the balls into a basket, wherein the deflector fingers are connected to a top end of the lift system.

* * * * *